United States Patent [19]

Wilson et al.

[11] 4,220,248

[45] Sep. 2, 1980

[54] CLOSURE WITH HINGED LID AND CAM AND SPRING ELEMENTS HOLDING LID OPEN OR CLOSED

[75] Inventors: Woodrow S. Wilson, Johnston; Robert E. Hazard, Kingstown, both of R.I.

[73] Assignee: Polytop Corporation, Slatersville, R.I.

[21] Appl. No.: 956,435

[22] Filed: Oct. 31, 1978

[51] Int. Cl.[3] ..... B67D 3/00

[52] U.S. Cl. ..... 215/235; 220/335; 222/517

[58] Field of Search ..... 222/498, 517, 543; 215/235, 237, 238, 244, 245; 220/335

[56] References Cited

U.S. PATENT DOCUMENTS

| | | | |
|---|---|---|---|
| 3,240,405 | 3/1966 | Abbott | 222/543 |
| 3,752,371 | 8/1973 | Susuki | 222/517 X |
| 3,853,250 | 12/1974 | Alpern | 222/517 |
| 4,010,875 | 3/1977 | Babiol | 222/517 |
| 4,158,902 | 6/1979 | Chernack | 222/517 X |

*Primary Examiner*—Donald F. Norton

*Attorney, Agent, or Firm*—Edward D. O'Brian; K. H. Boswell

[57] ABSTRACT

A complete closure including a closure member formed as a bottle cap or integrally with a container and lid connected to the closure member by a hinge or hinge-type structure may be constructed so as to utilize a spring structure and a cam structure serving to cooperate to hold the lid in either a closed position in which the lid covers an opening through the closure member or an open position in which the lid is spaced significantly from the opening. Preferably the complete closure is formed as an integral unit out of a polymer such as polypropylene in such a manner that the spring structure consists of upstanding resilient posts on the top of the closure member and so that the cam structure consists of substantially non-bending or rigid portions of the lid which are located so as to contact and deform the posts during movement of the lid. The complete closure is considered quite desirable because of its effectiveness and because it can be manufactured at a very nominal cost using straight pull injection molding dies to form the operative parts of the lid and the closure member.

10 Claims, 5 Drawing Figures

10
12
14
16
22
24
26
28
32
34
36
38
40
42
44
45
46
48
50
52
54
2
3

10
12
14
16
18
20
22
24
26
28
30
34
36
38
40
42
44
46
48
50
52
54

10
12
14
16
20
22
24
26
28
30
32
34
38
42
44
50
52
54

10
12
14
16
18
20
26
28
30
32
34
36
38
40
42
44
48
50
52
54

10
12
14
16
18
20
22
26
28
30
34
38
42
44
50
52

CLOSURE WITH HINGED LID AND CAM AND SPRING ELEMENTS HOLDING LID OPEN OR CLOSED

BACKGROUND OF THE INVENTION

The invention set forth in this specification pertains to a new and improved dispensing closure having a hinged lid and cam and spring elements for holding the lid in an open or closed position.

The term "dispensing closure" is commonly utilized to designate closures which are normally adapted to be attached to the necks of containers such as bottles, tubes or the like, but which may also be constructed so as to be integral with any such container and which are constructed so as to be capable of being opened or closed without being detached from the container. Such closures are normally constructed so as to include a base or bottom part as may be referred to as a closure member and a movable member mounted upon such a closure member in such a way so as to be capable of being manipulated so as to prevent or permit material being moved through the closure member.

The dispensing closures of the type to which this invention pertains are constructed so that such a movable member is a lid or lid member. Prior dispensing closures using such lids have frequently been constructed using separately manufactured lids which are assembled upon caps or similar closure members so as to be capable of being pivoted through the use of bearings and trunnions between open and closed positions. Such structures are considered to be comparatively undesirable in some applications because of the costs involved in separately manufacturing different parts and then assembling them together. Such closures employing pivotally mounted lids can present a manufacturing problem because of difficulties in easily and conveniently assembling bearings and trunnions without damaging one or more of the parts involved.

Dispensing closures employing lids have also been constructed utilizing straps to connect a cap or closure member with a lid. These structures have been manufactured with all parts integrally connected and with various physically connected separate parts. This strap type dispensing closure structure is considered disadvantageous because normally the strap employed tends to extend outwardly from the closure member so as to interfere with rapid, inexpensive capping operations. Any part of a closure tending to extend outwardly from the remainder of a closure is apt to be damaged by the operation of commonly utilized capping equipment. In addition, dispensing closures formed of a number of separately manufactured parts using lids connected by straps are disadvantageous because of cost and assembly problems.

Such dispensing closures employing lids connected by straps also share a disadvantage with closely related dispensing closures formed as unitary bodies with the lids connected to the closure members or caps by a so-called "live" hinge. Such closures have normally been manufactured out of polypropylene because of the well known properties of polypropylene in connection with hinge-type structures. This common disadvantage pertains to the manipulation of the lid in any such closure. When the lid in any such closure is in an open position in which an opening through the closure member or cap is uncovered the lid is apt to move about in such a way as to interfere with the discharge of material through the closure. This is very undesirable from a customer satisfaction standpoint.

This problem of the lid in a closure tending to interfere with the discharge of material through the closure has led to the comparatively recent development of a number of structures employing a toggle or toggle-type action between the lid of a closure and the closure member or cap of a closure for holding the lid so that it tends to cover the discharge opening in such a closure and for holding the lid away from such a discharge opening when the lid is in an open position. It is not considered that an understanding of the invention requires a detailed discussion of all of such toggle or toggle-type structures.

Certain of them are disadvantageous inasmuch as they require two separately formed parts and the assembly of these parts together. Certain of these structures are disadvantageous in that they utilize mechanical elements which tend to stick out from the periphery of the closure member or cap in such a manner as to make these closures undesirable for use with much standard capping equipment. Certain of these prior toggle or toggle-type dispensing closures are also undesirable from a purely aesthetic standpoint. This is quite important because dispensing closures are quite widely utilized in connection with containers for products in fields where aesthetic considerations tend to promote sales.

Not only are aesthetic considerations quite important in connection with the acceptability and utilization of dispensing closures. In addition, cost considerations are of extreme importance in this dispensing closure field. Because of the millions of dispensing closures which are manufactured and sold extremely small cost advantages are considered to be of extreme importance and can mark the difference between the success and failure of a specific closure. All too frequently prior dispensing closures utilizing lids and a toggle or toggle-type action to hold such lids in a closed and in an open position are considered to have been unnecessarily expensive because of molding costs or various costs involved in assembling such closures into a final, operative condition for use in capping equipment.

SUMMARY OF THE INVENTION

The preceding discussion is believed to convey several concepts. One of these is that the dispensing closure field is a crowded, worked-over field in which even minor variations or changes having any sort of an advantage may be critical or important from a commercial standpoint. Another of these is that there exists within this dispensing closure field a continuing need for new and improved dispensing closures which are more advantageous than prior known closures in one or more regards. A broad basic objective of the present invention is to provide new and improved dispensing closures in response to this need.

More specifically the invention is intended to provide new and improved dispensing closures which can be easily and conveniently manufactured at a comparatively nominal cost utilizing straight pull injection molding dies to form the operative parts of the lid and closure member. This is quite important with the invention since it directly pertains to the economics of dispensing closures in accordance with the invention. A further objective of the present invention is to provide dispensing closures as indicated which are constructed so that they can be easily and conveniently utilized without difficulty with conventional capping equipment. A further advantage of the invention relates to the fact that such closures are constructed so that there is virtually no danger of such capping equipment damaging them. Another objective of the invention is to provide dispensing closures as indicated which are constructed in such a manner that the lids on such closures will not normally remain in a stable position in which such lids might interfere with the discharge of material through such closures. This is quite important from a utilitarian standpoint.

In accordance with this invention the aforenoted objectives are achieved in the combination of a closure member havng an opening leading therethrough and a lid member attached to the closure member by hinge means so as to be capable of being located in a closed position in which the lid member covers the opening and so as to be capable of being moved away from the closed position to expose the opening by the improvement which comprises: spring means located on one of the members so as to extend generally toward the other of the members when the lid member is in the closed position, cam means located on the other of the members for deflecting the spring means as the lid member is moved into and out of the closed position, the cam means being shaped so as to be positioned adjacent to the spring means when the lid member is in the closed position and so as to abut the spring means without deflecting the spring means in holding the lid member away from the closed position, the cam means and the spring means being shaped so as to tend to make the position of the lid member relative to the closure member unstable as the lid member is moved toward and away from the closed position.

BRIEF DESCRIPTION OF THE DRAWING

The invention is best more fully described with reference to the accompanying drawing in which.

Figure 1:
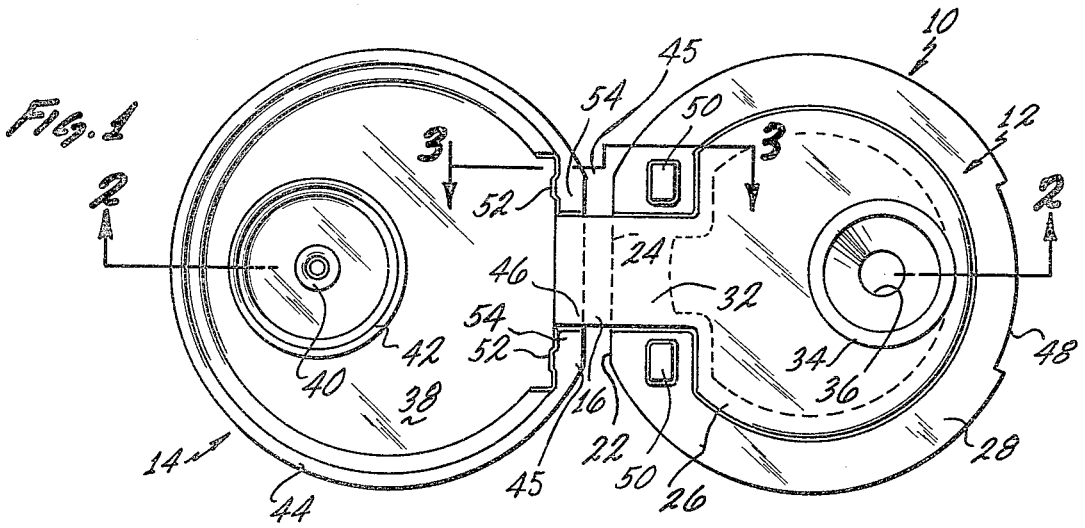
FIG. 1 is a top plan view of a complete closure in accordance with this invention as produced by an injection molding operation.

The dispensing closures of the present invention are constructed so as to embody the operative concepts or principles of the invention set forth and defined in the appended claims. These principles or concepts are, of course, embodied within the particular presently preferred dispensing closure illustrated but they may also be embodied within a number of somewhat differently constructed and differently appearing closures.

DETAILED DESCRIPTION

In the drawing there is shown a complete closure or dispensing closure 10 of the present invention which is constructed as a unitary body by conventional injection molding techniques out of a polymer material such as polypropylene or a similar polymer composition having similar physical properties. It will, of course, be recognized that polypropylene is capable of being utilized in a so-called "live" hinge. Further, depending upon the thickness of a polypropylene part or section such a part or section may either be capable of acting as a spring or may be substantially rigid and non-bending in character. These various properties of polypropylene are effectively utilized in the construction of this closure 10.

It includes a closure member or cap 12 which is connected to a lid or lid member 14 by means of a so-called "live" hinge 16. This hinge 16 consists of a long, line-like web or membrane of the same material used in forming the remainder of the complete closure 10. The particular closure member or cap 12 illustrated is shaped more or less as a conventional bottle cap so as to have a generally cylindrical skirt 18 provided with internal threads 20. If desired, this skirt 18 can be formed integrally with a container (not shown) in forming the closure 10 as part of the container. Other similar known means can be used instead of the threads 20 for mounting the closure 10 on a bottle or similar container.

The skirt 18 is not completely cylindrical in character and is provided with a small flattened area 22 corresponding to the cord of a circle. The hinge 16 is located along a straight edge 24 of a top 26 of the skirt 18. An annular recessed shoulder 28 is provided around the periphery (not separately numbered) of the top 26 generally between the top 26 and the skirt 18. A conventional sealing member 30 may be provided interiorly of the top 26 adjacent to the shoulder 28. It is noted that the shoulder 28 is generally parallel to the top 26 and extends completely around this top 26 except for an area 32 of the top 26 where the edge 24 is located. A nozzle-like boss 34 is provided on the top 26 remote from the area 32 around an opening 36 extending through the top 26.

Figure 4:
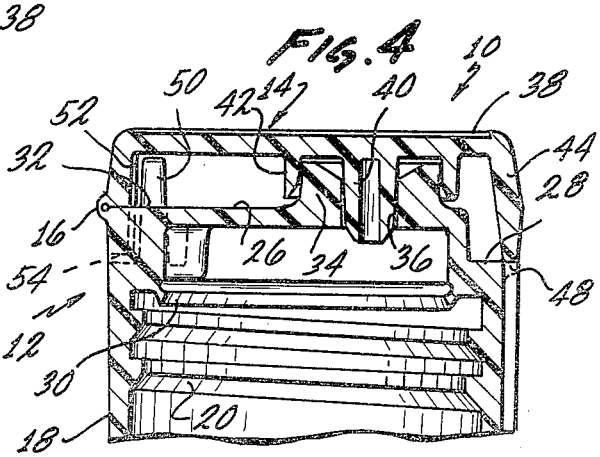
FIG. 4 is a cross-sectional view corresponding to FIG. 2 in which the lid member is shown in a closed position.
Figure 5:
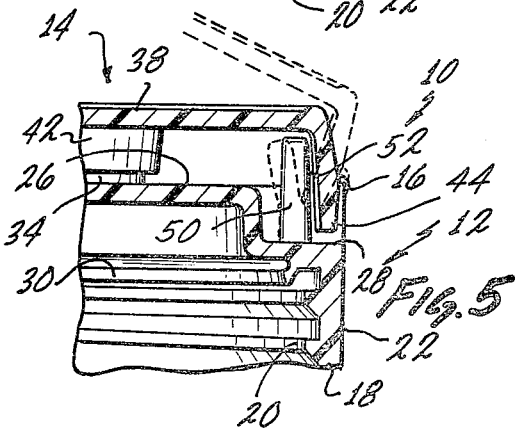
FIG. 5 is a partial cross-sectional view corresponding to FIG. 3 taken with the lid member in a closed position as indicated in FIG. 4.

The lid member 14 shown includes a normally flat top 38 which carries a conventional plug 40 adapted to fit within the opening 36 so as to close off this opening 36. Preferably an annular flange 42 is located concentrically around the plug 40 so as to be capable of fitting around the exterior of the boss 34 in order to create a second seal against the possibility of leakage when the lid 14 is in the closed position as indicated in FIG. 4. The lid 14 is also provided with a skirt 44 which is dependent from the periphery (not separately numbered) of the top 38. This skirt 44 terminates at ends 45 along an edge 46 corresponding to and parallel to the edge 24 described in the preceding. It will be apparent that these two edges 24 and 46 are connected by the hinge 16.

Figure 2:
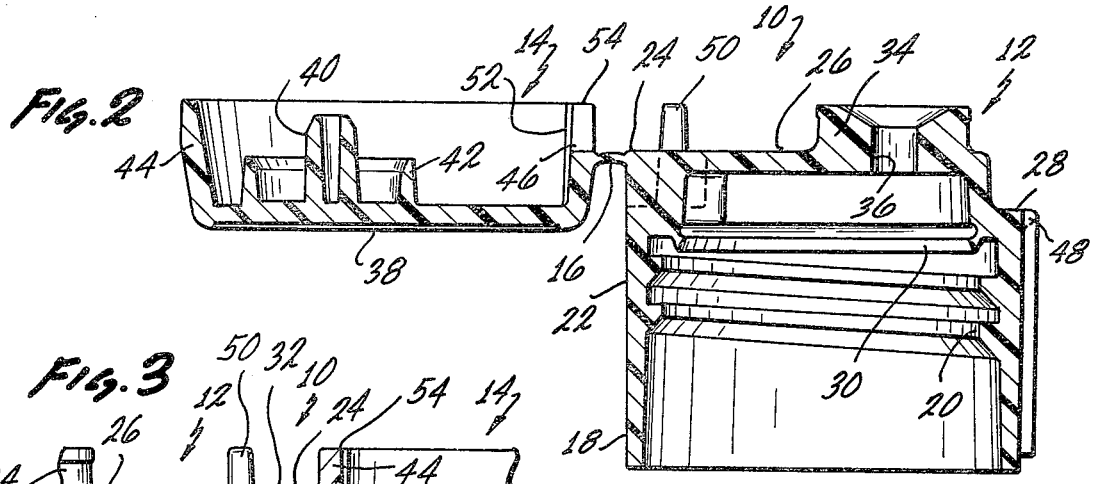
FIG. 2 is a cross-sectional view taken at line 2—2 of FIG. 1.
Figure 3:
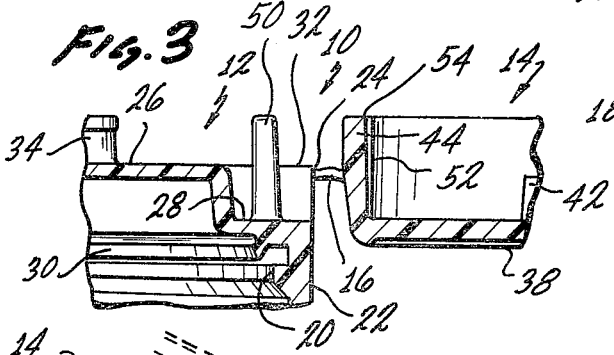
FIG. 3 is a partial cross-sectional view taken at line 3—3 of FIG. 1.

These edges 24 and 46 and the hinge 16 are dimensioned so that the lid 14 may be pivoted substantially about an axis (not shown) from a position as indicated in FIGS. 1 and 2 extending outwardly from the cap 12 in which it is formed by an injection molding operation to a closed position as indicated in FIG. 4. In this closed position the skirt 44 abuts against the shoulder 28 so as to in effect appear as a continuation of the skirt 18. In order to facilitate lifting of the lid 14 out of this closed position a small notch 48 may be provided within the skirt 18.

The various parts of the closure 10 described in the preceding reasonably correspond to certain prior dispensing closures having hinged lids. The closure 10, however, differs from such prior closures by employing two separate, resilient, upstanding posts 50 serving essentially as leaf springs which are located on the shoulder 28 on opposed sides of the area 32. These posts 50 are inwardly spaced from the exterior of the skirt 18 and are disposed symmetrically on opposite sides of an imaginary line transverse to the center of the hinge 16. These posts 50 are located where they will be engaged by cams or cam lugs 52.

These cams 52 are located on the top 38 of the lid 14 so as to in effect constitute extensions of and enlarged extremities of the skirt 44. In order to achieve an effective action of the cams 52 against the posts 50 which will minimize any chance of the lid 14 resting in a stable position in which the opening 36 is only partially or to a degree uncovered it is considered that the cams 52 should be comparatively thick so as to be substantially of a non-bending or inflexible character. However, it is noted that they can flex to a minor amount in an operative closure constructed as the closure 10. It is considered that if the cams 52 were sufficiently thin so as to be of a somewhat resilient spring-like character that this might tend to promote the stability of the lid 14 in a partially open position. It is also considered that this reasonably could be expected to interfere with the simplicity of the mechanical action achieved with the closure 10.

During movement of the lid 14 from a position as indicated in FIG. 1 to a closed position as indicated in FIG. 4 ends 54 of the cams 52 will abut against the posts 50 so as to push upon these posts 50 and temporarily deform or distend them. The cams 52 are dimensioned so that as the lid 14 reaches a closed position as indicated in FIG. 4, these cams 52 will be located adjacent to the posts 50 generally along side of and next to the posts 50. It will be recognized that this type of position is "stable". When the lid 14 is in this position the posts 50 will not be under any continuing pressure such as might cause a degree of creeping or deformation.

When the lid 14 is moved to an open position from a closed position as indicated in FIG. 4 the ends 54 of the cams 52 will again abut and temporarily deform the posts 50 until such time as the cams 52 are approximately perpendicular to the posts 50. This will hold the lid 14 so that it cannot swing back toward a closed position interfering with the discharge of material through the opening 36. When it is desired to close the lid 14 this lid 14 can, of course, be moved back to a closed position as indicated in the preceding.

This closure 10 is considered to have some distinct advantages. The posts 50 operate as springs or spring means against the cams 52 so as to make it substantially impossible for the lid 14 to be located in an only partially open position. This is desirable from a commercial standpoint. The particular closure 10 is also considered to be extremely desirable because of the ease with which operative parts of this closure may be manufactured at a comparatively nominal cost using injection molding dies having no undercuts. This materially contributes to the economics of the closure 10. This closure 10 is also advantageous in that it can be easily and conveniently utilized with conventional capping equipment without any significant danger or chance of damage to the closure. The fact that the hinge 16 does not project beyond the projected curvature of the skirt 18 of the closure member or cap 12 when the lid 14 is in a closed position is important in this regard.

Further, the closure 10 has a comparatively "neat", clean-cut appearance and is relatively simple because the cams 52 in effect form a part of the skirt 44 of the lid 14. In effect, these cams 52 are constructed as a part of such skirt 44 and are sufficiently rigid to effectively serve as a part of this skirt 44 and not as separate elements. This is considered to be advantageous.

An additional factor making the closure 10 especially desirable is that it is constructed so as to avoid exposed recesses or cavities within the top 26 which might accumulate deposits of material after the closure 10 has been used. The structure of this closure 10 is such as to minimize the possibilities of unsightly deposits being retained on the top 26 after use of the closure 10 while still permitting the closure 10 to have a very desirable appearance when the lid 14 is in a closed position. Further, the use of the cams or cam lugs 52 so that these are part of the skirt 44 in connection with the posts 50 being located adjacent to what may be regarded as the exterior of the closure 10 permits closures corresponding to the closure 10 to be constructed with openings of virtually any desired diameter within the top 26. This is important since it allows closures corresponding to the closure 10 to be utilized with a variety of different products.

We claim:

1. In a combination of a closure member having an opening leading therethrough and a lid member attached to said closure member by a hinge means so as to be capable of being located in a closed position in which said lid member covers said opening and so as to be capable of being moved away from said closed position so as to expose said opening the improvement which comprises:

said closure member having a cylindrical peripheral skirt shaped so as to include a flattened external area corresponding to the chord of a circle in the exterior of said skirt of said closure member adjacent to the top edge thereof, the projected curvature of said skirt of said closure member extending adjacent to said chord, said closure member having a top which is covered by said lid member when said lid member is in said closed position, and including an annular peripheral shoulder, said lid member having a top and a dependent skirt having a flattened edge corresponding to and adjacent to the top edge of said flattened area of said skirt, which skirt of said lid member fits against said peripheral shoulder when said lid member is in said closed position, two separate cooperating means for making the position of said lid member relative to said closure member unstable as said lid member is moved toward and away from said closed position, one of said cooperating means being located on said skirt of said lid member adjacent said flattened area and appearing as a continuation of said skirt, the other of said cooperating means being located on said top of said closure member, one of said cooperating means comprising a spring means and the other of said cooperating means comprising a cam means, said closure and lid members, said hinge means, said spring means and said cam means being integral with one another and being constructed of a polymer composition, the flexibility and deformability of which varies in accordance with the thickness of the polymer composition, said spring means being located on one of said members so as to extend generally toward and parallel to the other of said members when said lid member is in said closed position, said cam means being located on the other of said members in a position to deflect said spring means as said lid member is moved into and out of said closed position, said spring means and said cam means are located interiorly of the exterior of said lid means and said skirt on said closure means when said lid member is in said closed position and being located generally between said lid member and said closure member when said lid is in said closed position, said cam means being shaped so as to be positioned adjacent to said spring means when said lid member is in said closed position and so as to abut said spring means without deflecting said spring means in holding said lid member away from said closed position, said cam means and said spring means being shaped so as to tend to make the position of said lid member relative to said closure member unstable as said lid member is moved toward and away from said closed position, said hinge means extending along a part of the top edge of said flattened area of said skirt of said closure member and not projecting beyond the projected curvature of said skirt of said closure member extending adjacent to said chord, when said lid member is in said closed position.

2. The combination claimed in claim 1 wherein:

said spring means comprises resilient, deformable post means extending upwardly from said closure member, said cam means comprises lug means located on said lid member, said lug means being located so as to engage and deflect said post means as said lid member is moved into and out of said closed position.

3. The combination claimed in claim 2 wherein:

said hinge means is one hinge having ends, there are two of said post means and two of said lug means, one of said post means and one of said lug means being located adjacent to one end of said hinge means, the other of said post means and the other of said lug means being located adjacent to the other end of said hinge means.

4. The combination claimed in claim 1 wherein:

said closure member is a bottle cap, said hinge means is one hinge having ends, said bottle cap includes a top, said skirt on said lid member has ends adjacent to the ends of said hinge, said cam means comprise lugs of a substantially inflexible character located at the ends of said skirt of said lid member adjacent to the ends of said hinge means, said spring means comprise posts located on said shoulder so as to extend upwardly therefrom, each of said posts being located so as to be capable of being engaged by one of said lugs as said lid member is moved into or out of said closed position, said lugs are integral with the ends of said skirt of said lid member, said lugs are positioned adjacent to and do not deflect said posts when said lid member is in said closed position and are capable of abutting said posts so as to hold said lid member so that said lid member will not interfere with the movement of material through said opening.

5. The combination claimed in claim 1 wherein:

said cam means is capable of flexing during movement of said lid member toward and away from said closed position as said cam means contacts said spring means.

6. The combination claimed in claim 5 wherein:

said cam means is of a somewhat resilient, spring-like character.

7. The combination claimed in claim 1 wherein:

the one of said cooperating means on said lid member is said cam means.

8. The combination claimed in claim 1 wherein:

said cam means comprise lugs of a substantially inflexible character located at the ends of said skirt of said lid member adjacent to the ends of said hinge means, said spring means comprise posts located on said shoulder and said lid member so as to extend upwardly therefrom, each of said posts being located so as to be capable of being engaged by one of said lugs as said lid member is moved into or out of said closed position.

9. The combination claimed in claim 8 wherein said lugs are integral with the ends of said skirt of said lid member.

10. The combination claimed in claim 8 wherein:

said lugs are positioned adjacent to and do not deflect said posts when said lid member is in said closed position and are capable of abutting said posts so as to hold said lid member so that said lid member will not interfere with the movement of material through said opening.

* * * * *